US006280241B2

(12) United States Patent
Herlinger et al.

(10) Patent No.: US 6,280,241 B2
(45) **Date of Patent: *Aug. 28, 2001**

(54) FLAT CABLE DROP CONNECTION SYSTEM

(75) Inventors: George Raymond Herlinger, Niles, OH (US); Vickey E. Reed, Beaver Falls, PA (US); Joseph Albert Svette, Jr., Newton Falls, OH (US); David Glen Siegfried, Vienna, OH (US); Anne F Monroe, Cortland, OH (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/458,516

(22) Filed: Dec. 13, 1999

(51) Int. Cl.[7] ..... H01R 12/24
(52) U.S. Cl. ..... 439/496

(58) Field of Search ..... 439/496, 329, 439/67, 493

(56) References Cited

U.S. PATENT DOCUMENTS 3,253,248 * 5/1966 Brown ..... 339/99
4,731,273 * 3/1988 Bonk et al. ..... 428/57

FOREIGN PATENT DOCUMENTS

1522029 * 8/1978 (GB) ..... 439/496

* cited by examiner

*Primary Examiner*—Gary Paumen
*Assistant Examiner*—P Nguyen
(74) *Attorney, Agent, or Firm*—Patrick M. Griffin

(57) ABSTRACT

A flat cable connection system includes a flat cable module having a power input segment and drop connectors that provides a low profile configuration; the drop connectors include a spring component, a non-spliced flat cable end portion and a connector body that serves to capture the flat cable end portion and to provide an electrical connection to an electrical accessory of the type associated with a headliner of a vehicle.

11 Claims, 6 Drawing Sheets

FLAT CABLE DROP CONNECTION SYSTEM

FIELD OF THE INVENTION

This invention relates to flat conductors and more particularly to flat cable connection systems for use in vehicle electrical systems.

BACKGROUND OF THE INVENTION

U.S. Pat. No. 4,756,283 discloses the use of flat cables in an automotive electrical system. While suitable for their intended purpose such flat cable designs do not address how to provide a readily assembled, positive connection between a flat cable system having multiple drop locations requiring electrical connection between the cable and electrical devices associated with the headliner and sun visor accessories of a motor vehicle.

One problem with such overhead systems is that different architectures are required for different vehicle applications. The need to provide a wide range of connector systems increases handling and assembly costs. Furthermore, in headliner applications the use of traditional round wire wiring packages can cause undesirable bulge regions that can pinch, cut or chafe the wiring. Furthermore, such arrangements require elaborate taping to secure the package on a headliner.

Another problem with such traditional round wire bundles is that they do not define consistent parallel conductor paths. Consequently, electro magnetic and radio frequency interference can result.

SUMMARY OF THE INVENTION

The object of this invention is to provide a flat cable connection system that is formed as a module with consistently parallel conductor paths and that has a plurality of electrical drop connections.

A further object is to provide such a system wherein branches of the system are located in a common low profile configuration and include non-spliced terminal segments.

A further object is to provide such a low profile configuration having adhesive patches for securing the system with respect to a headliner.

A feature of the flat cable connection system of the invention is that the flat cable has one or more a flat cable end segments backed by a spring element for biasing conductors in the end segments terminal segments and for releasably connecting them with respect to mating surfaces on electrical terminals in a connector body and wherein the flat cable end segments have conductors thereon that define a terminal that does not require wire splices.

Another feature of the flat cable connection system of the invention is that the connection system has one or more connector bodies arranged to receive non-spliced terminal segments on the flat cable.

Still another feature of the flat cable connection system of the invention is that the connection system includes a non-spliced terminal segment that is wrapped around a spring that shapes the terminal segment for connection to a drop in connector body located below the non-spliced terminals.

Another feature is to shape such terminal segment to define an up ramp at a forward end and to define a down ramp at a rearward end of the loop and wherein the up ramp is spring biased to form a wipe contact action.

Yet another feature of the flat cable connection system of the invention is that the flat cable includes one or more vertically depending segments thereon that are configured to be placed in vertically upwardly stowed positions or deployed in vertically dropped positions for connection to associated electrical devices.

Still yet another feature of the flat cable connection system of the invention is that the connection system includes a plurality of connector bodies that are loosely mounted on relatively rigid supports for electrical connection to associated electrical devices and wherein the depending segments of the flat cable are configured to be attached to the connector body without adjusting the position of the flat cable architecture.

Still yet another feature of the flat cable connection system of the invention is that the flat cable connection system has a spring member configured to have a flat cable end wrapped thereon to provide a spring biased electrical connection between exposed conductors in the flat cable and a terminal within a connector body having a cavity for receiving the wrapped flat cable.

Yet another feature of the flat cable connection system of the invention is that the connector body includes a first portion thereon adjustably connected to a support member and a second portion forming a socket for receiving depending terminal segments of the flat cable supply array to facilitate insertion of the terminal segments into the connector body and to provide a strain relief between the flat cable array and the connector body.

Still another object of the invention is to provide a latch connection between the spring and the connector body for retaining the looped end of the flat cable drops connection within the connector body.

These and other objects, features and advantages of the flat cable connection system of the invention will become apparent in connection with the detailed description of the flat cable connection system of the invention below.

DETAILED DESCRIPTION OF PREFERRED EMBODIMENT

Figure 1:
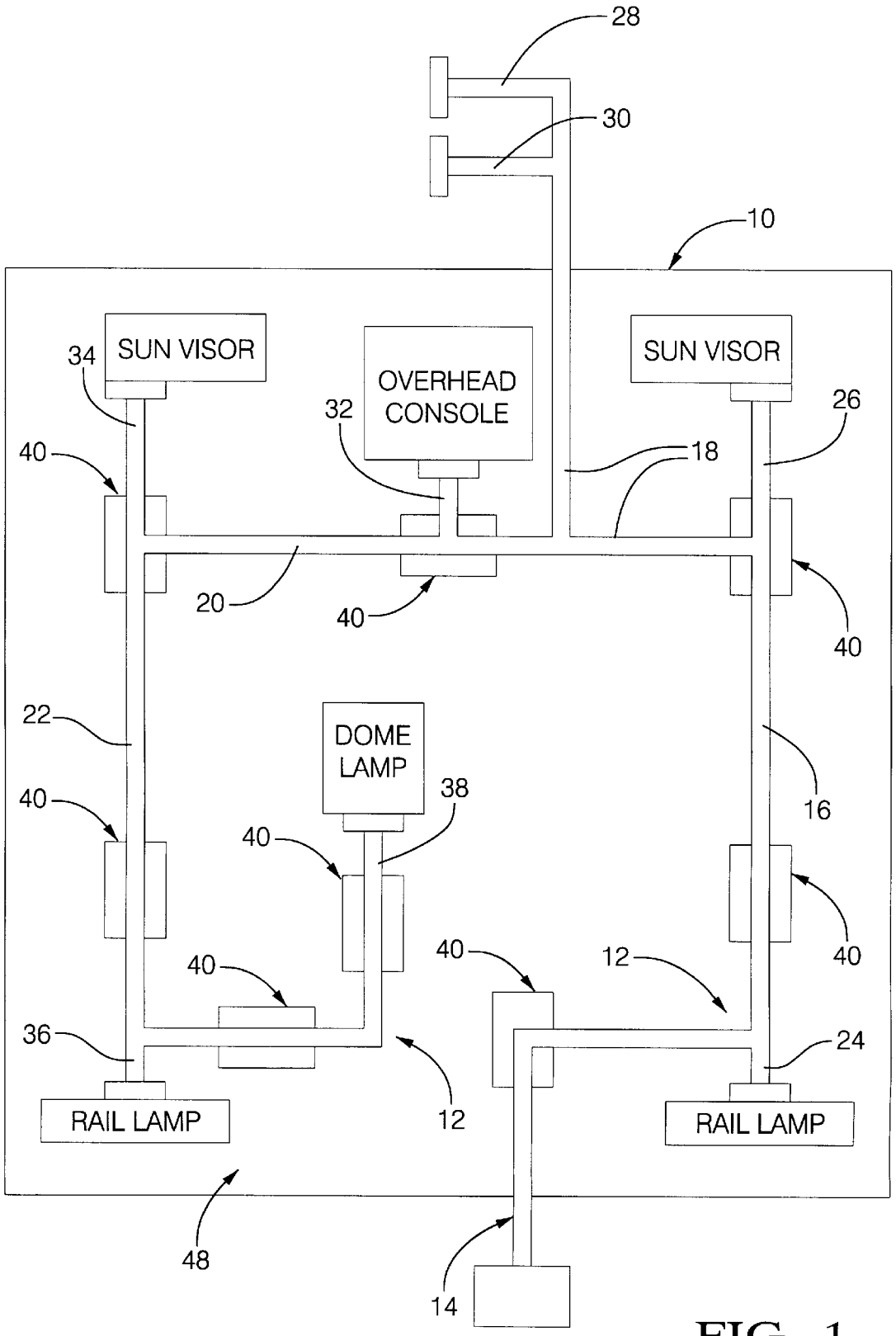
FIG. 1 is a diagrammatic view of a flat cable connection system of the invention.

Referring first to FIG. 1, a flat cable connection system 10 of the invention is shown as a diagrammatic overhead view of a vehicle headliner region. The flat cable connection system 10 includes a flat cable module 12 having a power input segment 14 that includes power feed segments 16, 18, 20 and 22 and connector segments 24, 26, 28, 30, 32, 34, 36 and 38 each having a terminal segment thereon to be described. The flat cable module 12 is located in substantially a common plane and thus provides a low profile configuration that is easily connected by adhesive patches 40.

Each adhesive patch 40 has a bent segment 42 having a first adhesive surface 44 that connects to the inboard surface of the various segments of the module 12. Each patch 40 also has a straight segment 45 having an adhesive surface 46. The surfaces 44, 46 are covered by removable tape prior to use so as to enable the module 12 to be handled as a unit prior to assembly within a vehicle type. When the tape cover is removed, the surface 46 connects to a headliner 48 and the surface 44 connects to the module 12 to secure it in a low profile position.

Figure 2:
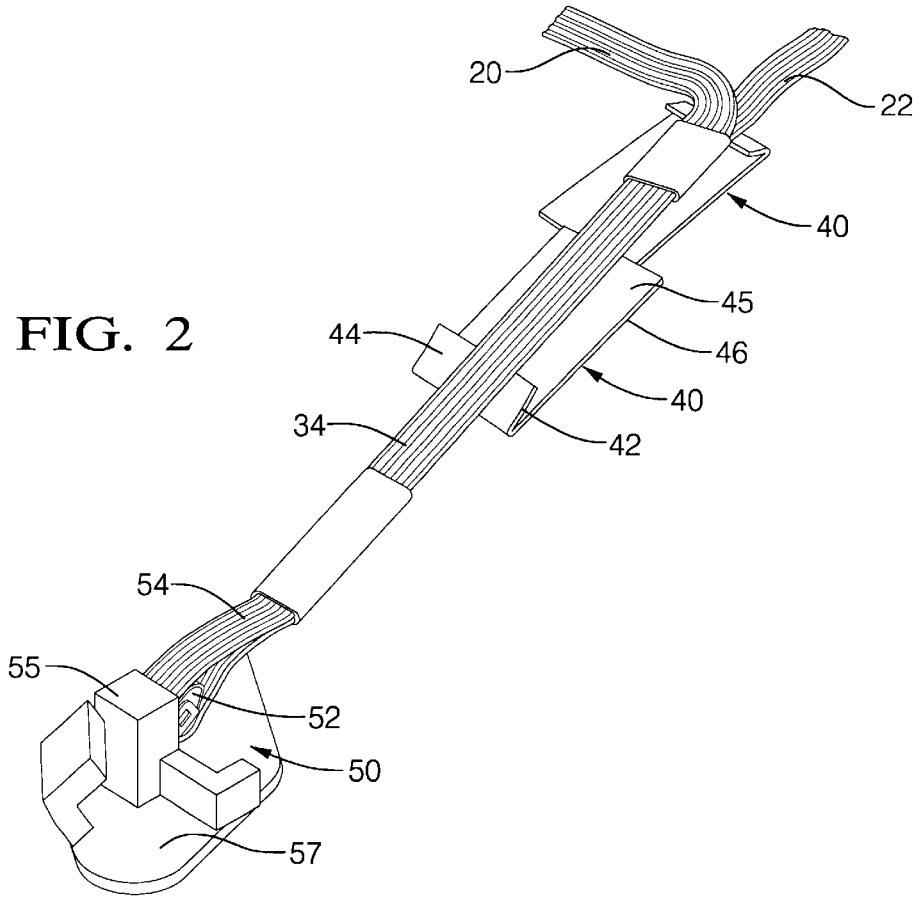
FIG. 2 is a perspective view of a portion of a flat cable connection system of the invention associated with a vehicle headliner.
Figure 3:
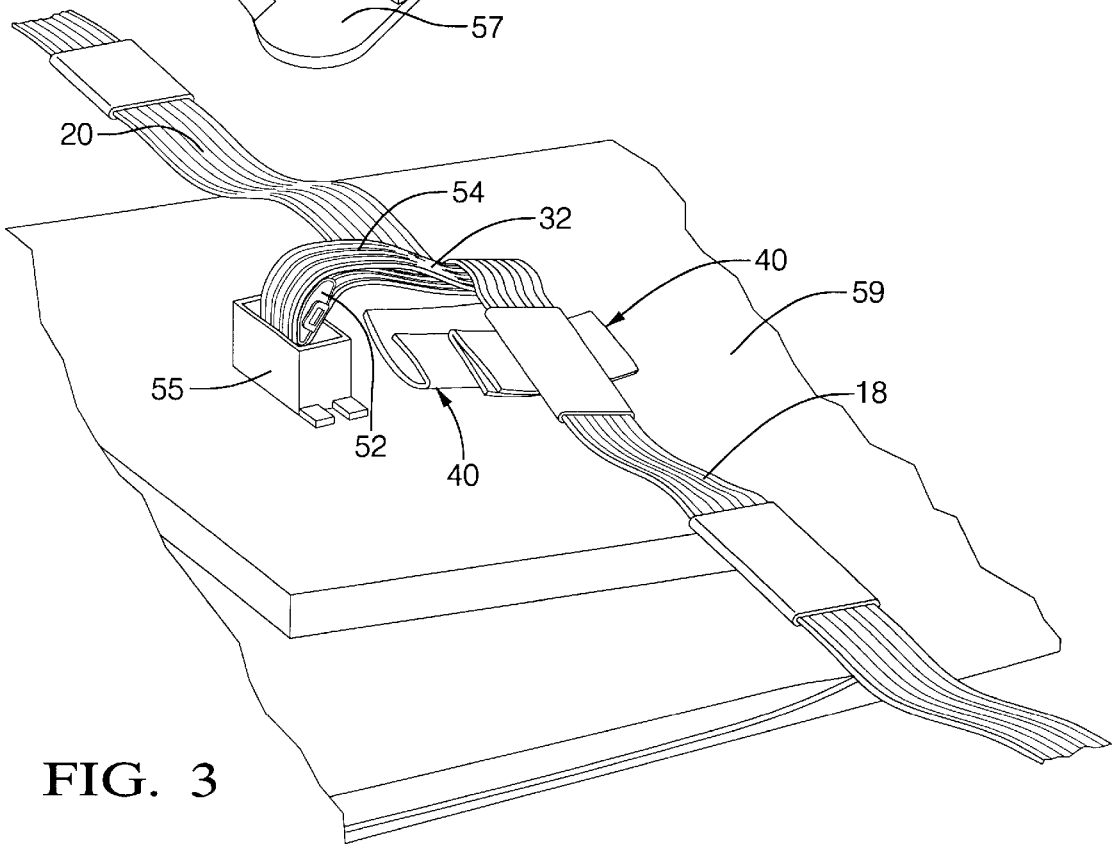
FIG. 3 is a fragmentary perspective view of a drop connector shown in association with an overhead console.

The module 12 further includes a plurality of drop and lock connections 50, shown in FIG. 2. Each of the connections 50 includes a spring component 52, a flat cable end portion 54 and a connector body 55 that serves to capture the flat cable end portion and to provide an electrical connection to an electrical accessory of the type associated with a headliner of a vehicle including but not limited to sun visors having lighted mirrors; overhead consoles that include lighting and a landing port for a garage door operator; such accessories can also include dome lights and rail lights. The arrangement enables one or more of the flat cable end portions 54 to be held by tape in a common plane with the other flat cable segments or to be deployed downwardly as shown in FIGS. 2, 3 for connection to a connector body 55 as will be described.

FIG. 2 shows the connection of the module 12 at a sun-visor 57. FIG. 3 shows the connection of the module 12 at a console 59 and wherein like components are identified with the same reference numeral printed.

Such an arrangement enables one preassembled module to be suitable for use in a range of vehicle types that can have varying types of headliner electrical accessories. For example, some car models might include lighted visors and others might not. In such cases the associated flat cable end portions can be easily fabricated as a low profile module to be deployed for connection to the accessory depending upon vehicle type. The flat cable module 12 can include one or more vertically depending segments thereon that are configured to be deployed in various drop-in positions for connection to associated electrical devices.

Figure 4:
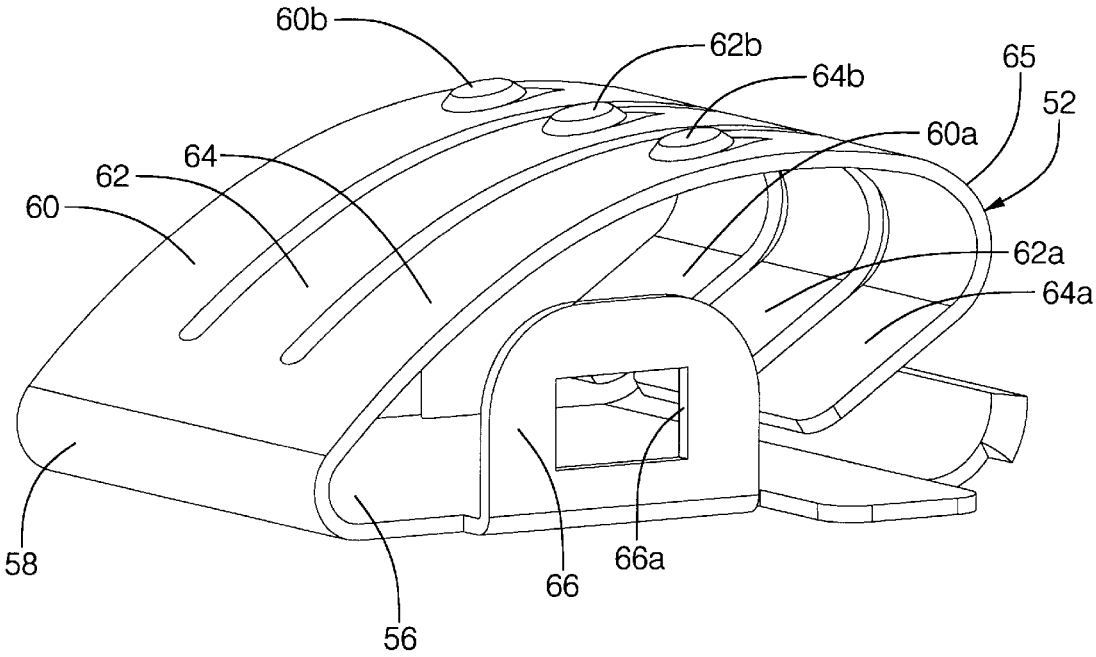
FIG. 4 is an enlarged perspective view of a spring component in the connector shown in FIG. 3.

As best shown in FIG. 4 each of the spring components 52 has a base 56 joined by a curved end wall 58 that connects to three spaced upwardly bent segments 60,62, 64 that have inwardly turned ends 60*a,* 62*a,* 64*a* defining an up ramp 65. A side tab 66 is integrally connected to the base 56 on each side thereof. It includes an opening 66*a* therein that defines a latch opening 66*a* adapted to interconnect with a lock member to be described. The configuration of the base 56, bent segments 60,62,64 and curved end wall defines a support for the end flat cable and the end portion thereon as shown in FIGS. 2 and 3.

The cable end portions 54 each have a loop 70 (best shown in FIG. 8) that is shaped by the surfaces of the base 56 and bent segments 60–64 and it is secured by suitably fastening the terminus 72 of the loop against an adjacent portion 54*a* of the end portion 54.

By virtue of the configuration of the loop 70 and the spring action of the bent spring segments 60–64, a spring force is provided behind the cable end portion 54 against conductors 74, 76 and 78 to cause exposed segments 74*a,* 7*a,* 78*a* thereon to be held in electrical contact with a mating surface 80. The mating surface can be a terminal plate, a printed circuit board or other known electrical connection found in automotive electrical applications. In the embodiment shown in FIGS. 2–8, the loop 70 defines a non-spliced terminal segment that is wrapped around a spring that shapes the terminal segment for connection to a drop in connector body 55.

Figure 8:
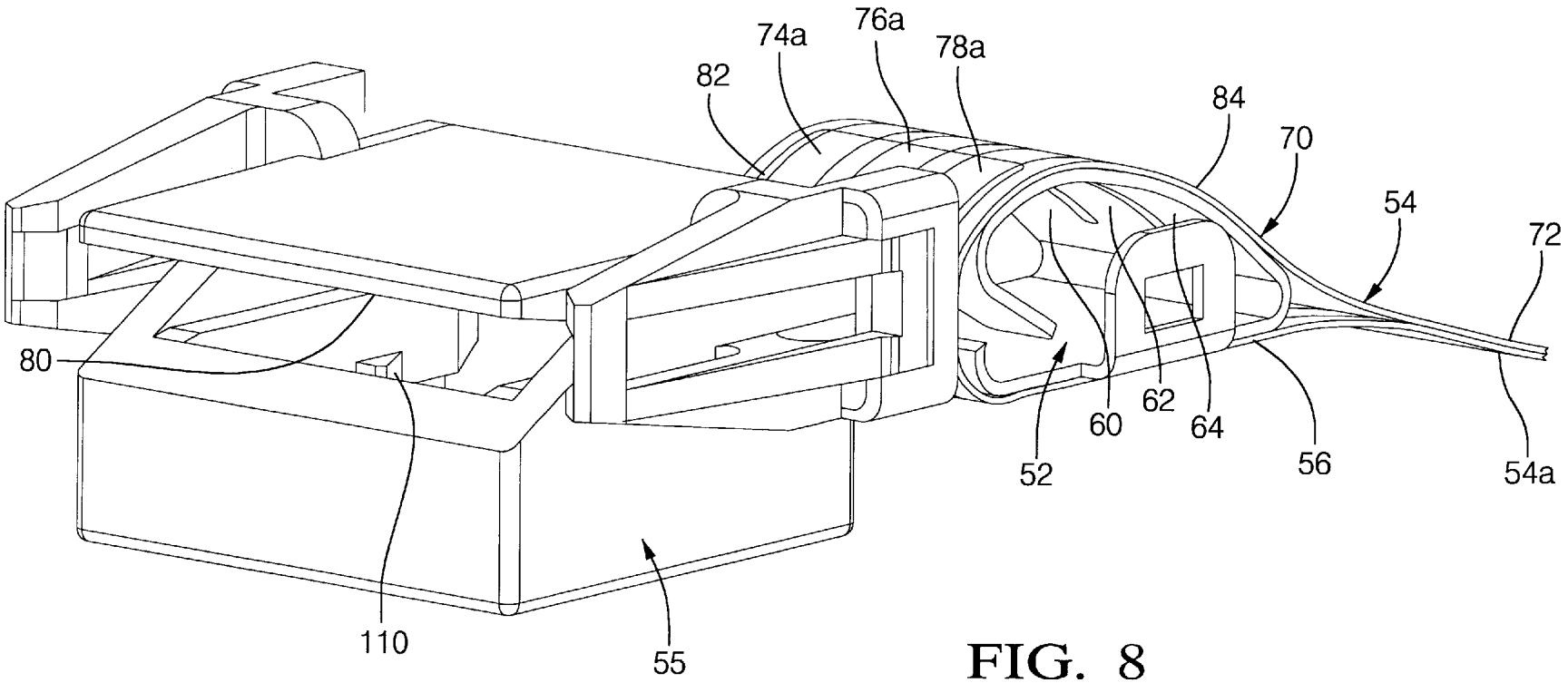
FIG. 8 is an exploded perspective view of a flat cable end, spring and connector body from the opposite end of the connector body shown in FIG. 6 prior to assembly.

As shown in FIG. 8, the loop 70 defines an up ramp 82 at a forward end and defines a down ramp 84 at a rearward end of the loop and wherein the up ramp is spring biased to form a wipe contact action at exposed conductor segments 74*a,* 76*a,* 78*a* when assembled with respect to the mating surface.

The connection system 10 is associated with one or more connector bodies 55 that are loosely mounted on relatively rigid supports for electrical connection to associated electrical devices and wherein the depending segments of the flat cable are configured to be attached to the connector body without adjusting the position of the flat cable architecture.

More particularly each connector body 55 includes a first portion 90 having two side spring clip locks 92, 94 located on outer opposite sides 96, 98 of the first portion 90 that will allow the connection system components to be aligned and that will lock the connector body 55 to a mating surface that can be connected to a relatively rigid support portion of the vehicle.

The connector body 55 includes a second portion 100 that forms a cavity 102 into which the loop 70 and spring 52 can be inserted. The cavity 102 has sidewalls 104, 106 that include ramped lock tabs 108, 110, respectively. The lock tabs 108, 110 engage the openings 66*a* in the tabs 66 defining a latch that will contain the loop 70 and spring 52 within the connector body 55 and will prevent the spring component 52 from being backed out of the connector body 5. The top wall 112 and bottom wall 114 of the cavity 102 serve to guide the up ramp 82 into the cavity until the lock tabs 108, 110 engage. At this point the bent spring segments 60–64 of the spring component 52 at raised buttons 60*b,* 62*b,* 64*b* to exert a spring biasing action behind the cable end portion 54 to cause exposed segments of conductors 74, 76 and 78 thereon to be held in electrical contact with the mating surface 80.

In the illustrated arrangement the conductors 74–78 are copper conductors with a Mylar film laminated to both sides thereof. The exposed segments 74*a,* 76*a,* 78*a* are located in an exposed window 112 in the topside of the loop 70 for providing a contact surface; raised buttons 60*b,* 62*b,* 64*b* concentrate the spring force against the Mylar film on the inside of the loop 70 so as to assure good electrical contact between the exposed segments 74*a*–78*a* and the mating surface 80. The flat cable cooper conductors may be coated with an anti-tarnish coating or may be plated with a suitable protective and conductive metal such as tin or gold for lower contact force as well as to protect the copper from corrosion or tarnish.

Figure 5:
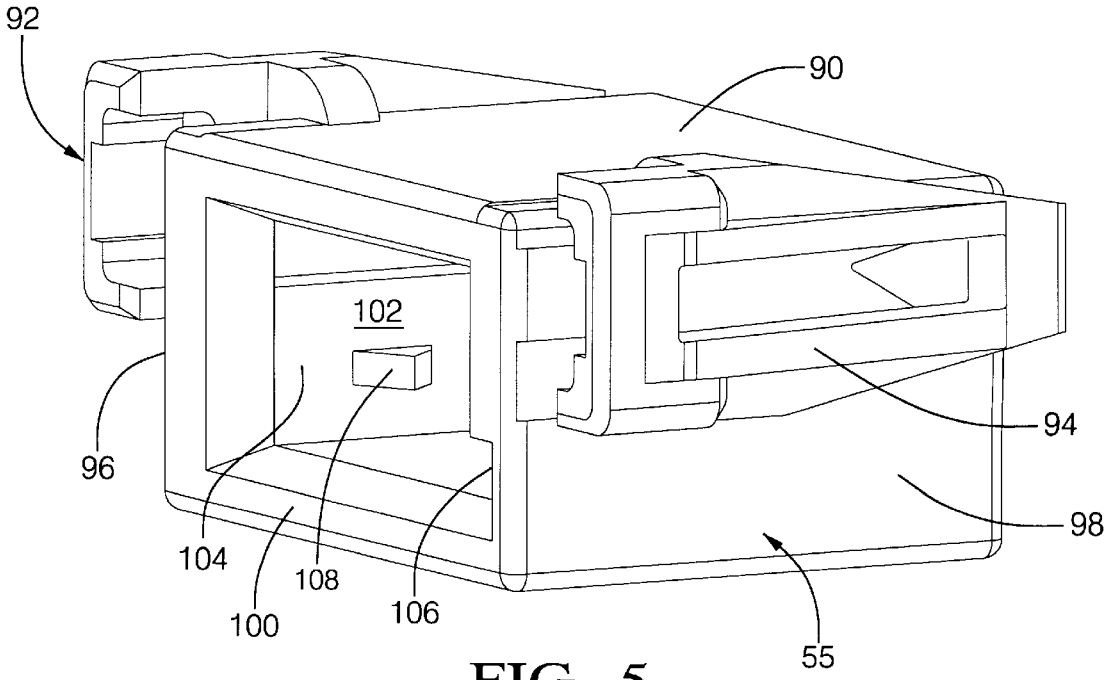
FIG. 5 is an enlarged perspective view of a connector body component in the connector shown in FIG. 3.
Figure 6:
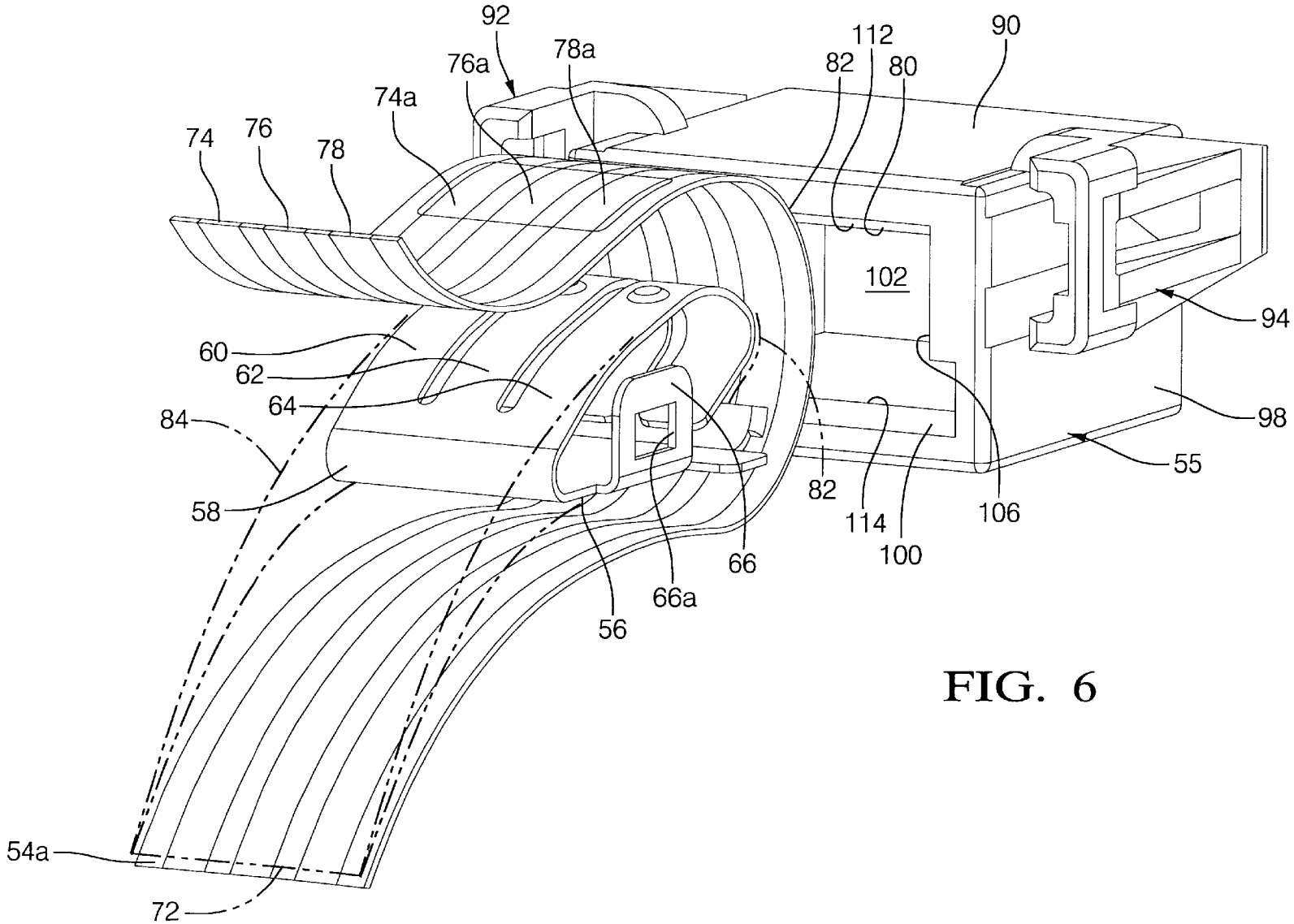
FIG. 6 is an exploded perspective view of a flat cable end, spring and connector body from one end of the connector body prior to assembly.
Figure 7:
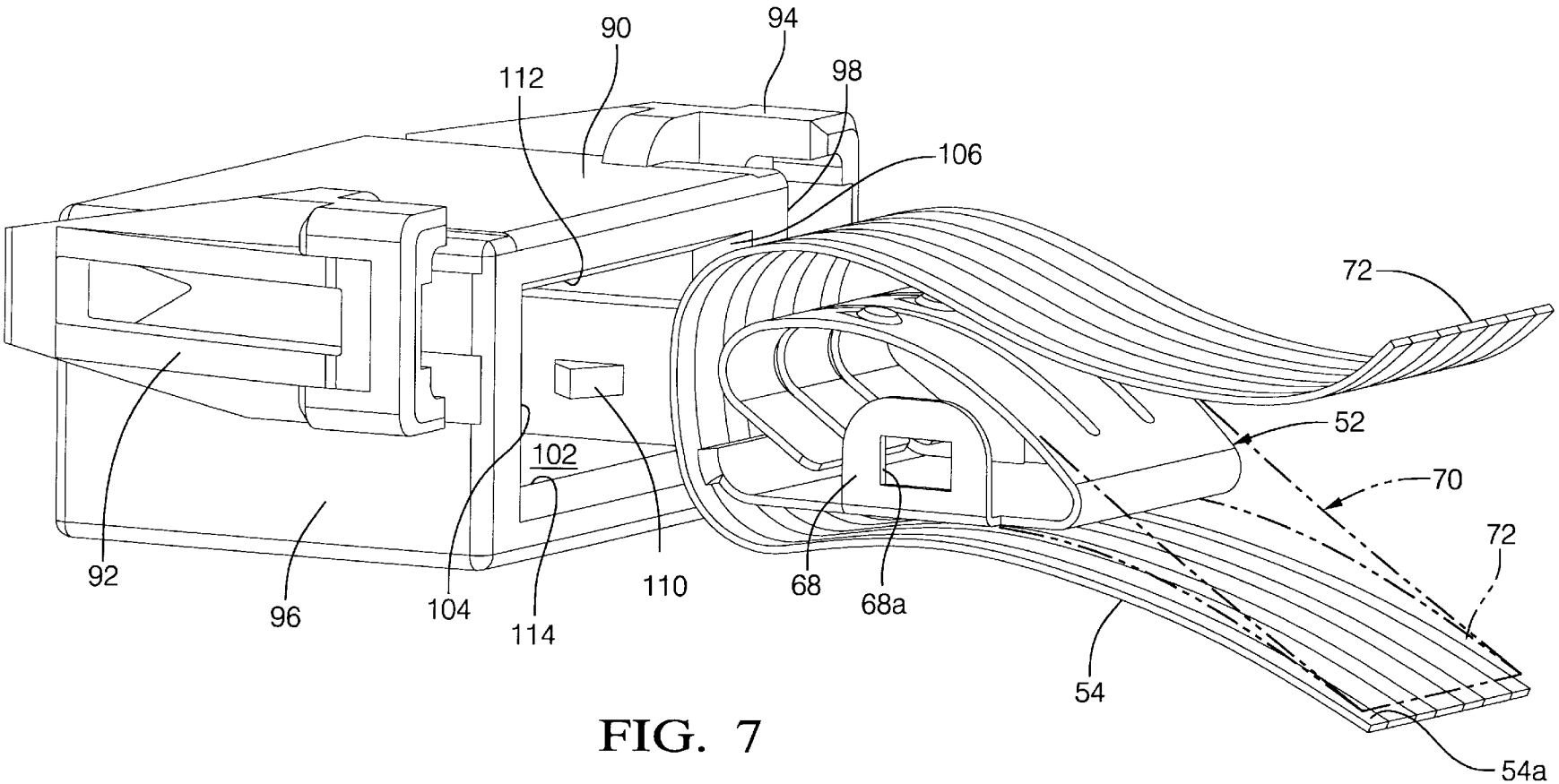
FIG. 7 is a view like FIG. 6 of a flat cable end, spring and connector body from the opposite end of the connector body shown in FIG. 6 prior to assembly.

As shown in FIG. 5, the loop 70 and underlying spring 52 define an easily inserted electrical connection that can be directed into the housing 50 for producing an electrical connection between the module 12 and an associated electrical accessory.

Many modifications and variations of the present invention in light of the above teachings may be made. It is, therefore, to be understood that, within the scope of the appended claims, the invention may be practiced otherwise than as specifically described.

We claim:

1. A flat cable connection system comprising:

a flat cable module having a plurality of power feed segments and a plurality of connector segments, each of the connector segments having a non-spliced terminal segment having spaced conductors formed thereon, a plurality of connector bodies, one connector body of the plurality of connector bodies for each of the connector segments located in spaced relationship to the plurality of power feed segments of said flat cable module, said connector body having a first portion forming a cavity for said non-spliced terminal segment of each of the connector segments; a mating surface within said cavity, the mating surface facing inwardly for providing an electrical contact therein;

a spring component for shaping said non-spliced terminal segment; said non-spliced terminal segment having the spaced conductors formed thereon biased outwardly by said spring component, said non-spliced terminal segment being insertable into said cavity and said spaced conductors being biased outwardly within said cavity to provide a contact with said electrical mating surface within said connector body.

2. The flat cable system as defined in claim 1 wherein at least one of the connector segments is a depending segment on said flat cable module having a deployed position wherein said terminal segment is connected to said connector body.

3. The flat cable connection system of claim 1, further including a headliner wherein said flat cable module locatable in a flat disposition on said headliner.

4. The flat cable connection system of claim 1, wherein said non-spliced terminal segment defines an up ramp at a forward end and a down ramp at a rearward end thereof and wherein the up ramp is spring biased to form a wipe contact action.

5. The flat cable connection system of claim 1, wherein said flat cable connection system includes one or more vertically depending connector segments thereon that are configured to be deployed in vertically dropped positions for connection to associated electrical devices.

6. The flat cable connection system of claim 1, including a plurality of connector bodies and wherein said non-splice terminal segments are configured to be attached to one of said connector bodies without adjusting the position of the plurality of power feed segments.

7. The flat connection system of claim 1, including a support;

said connector body including a portion thereon adjustably connected to said support to facilitate insertion of a terminal segment into said connector body and to provide a strain relief between the flat cable module and said connector body.

8. A flat cable module having a plurality of power feed segments and a plurality of connector segments, each of the connector segments having a non-spliced terminal segment, a plurality of connector bodies located at spaced points with respect to the flat cable module and each other, one connector body of the plurality of connector bodies for each of the connector segments located in spaced relationship to the plurality of power feed segments of said flat cable module, said one connector body having a first portion forming a cavity for said non-spliced terminal segment of each of the connector segments; a mating surface within said cavity, the mating surface facing inwardly for providing an electrical contact therein;

a spring component for shaping said non-spliced terminal segment; said non-spliced terminal segment having spaced conductors formed thereon biased outwardly by said spring component, said non-spliced terminal segment being insertable into said cavity and said spaced conductors being biased outwardly within said cavity to provide a contact with said electrical mating surface within said one connector body, and a headliner, the plurality of power feed segments of said flat cable module being located in a common low profile configuration and adhesive patches for securing said low profile configuration with respect to said headliner.

9. The flat cable connection system of claim 8 wherein said non-spliced terminal segments are one or more folded flat cable end segments with exposed conductors; a spring element for biasing said conductors in said folded flat end segments to produce a wiping contact between said exposed conductors and said mating surface.

10. A flat cable module having a plurality of power feed segments and a plurality of connector segments, each of the connector segments having a non-splice terminal segment, a connector body for each of the connector segments located in spaced relationship to the plurality of power feed segments of said flat cable module, said connector body having a first portion forming a cavity for said non-spliced terminal segment of each of the connector segments; a mating surface within said cavity, the mating surface facing inwardly for providing an electrical contact therein;

a spring component for shaping said non-spliced terminal segment; said non-splice terminal segment having spaced conductors formed thereon biased outwardly by said spring component, said non-spliced terminal segment being insertable into said cavity and said spaced conductors being biased outwardly within said cavity to provide a contact with said electrical mating surface within said connector body and non-spliced terminal segment being wrapped around said spring component and including an end portion that has a loop that is shaped by said spring component and secured by fastening a portion of the loop against an adjacent portion of the end portion.

11. The flat cable connection system of claim 10 including a latch connection between said spring component and the connector body for retaining said non-spliced terminal segment within said body.

* * * * *